US005669356A

United States Patent [19]

Wall et al.

[11] Patent Number: 5,669,356

[45] Date of Patent: Sep. 23, 1997

[54] CONTROL VALVE

[75] Inventors: Robin Christopher Wall; Trevor Alan Fuller, both of Kent, England

[73] Assignee: Lucas Industries, England

[21] Appl. No.: 540,687

[22] Filed: Oct. 11, 1995

[30] Foreign Application Priority Data

Oct. 28, 1994 [GB] United Kingdom ..... 9421723

[51] Int. Cl.[6] ..... F02M 41/00

[52] U.S. Cl. ..... 123/467; 137/514.3; 123/506

[58] Field of Search ..... 123/467, 510, 123/446, 506; 137/514, 514.3, 514.5, 514.7, 504, 512.2

[56] References Cited

U.S. PATENT DOCUMENTS

| | | | |
|---|---|---|---|
| 2,554,390 | 5/1951 | Stevenson | 137/514.3 |
| 3,742,926 | 7/1973 | Kemp | 123/467 |
| 4,246,876 | 1/1981 | Bohringer | 123/467 |
| 4,478,189 | 10/1984 | Fenne | 123/467 |
| 4,682,531 | 7/1987 | Mayer | 137/514.5 |
| 4,926,902 | 5/1990 | Nakamura | 123/467 |
| 5,012,785 | 5/1991 | Long | 123/467 |
| 5,050,636 | 9/1991 | Sagawa | 137/514 |
| 5,295,469 | 3/1994 | Kariya | 123/467 |
| 5,339,785 | 8/1994 | Wilksch | 123/467 |
| 5,390,692 | 2/1995 | Jones | 123/467 |

FOREIGN PATENT DOCUMENTS

| | | |
|---|---|---|
| A-0325858 | 12/1988 | European Pat. Off. . |
| A-0410149 | 6/1990 | European Pat. Off. . |

OTHER PUBLICATIONS

Patent Abstracts of Japan, vol. 10 No. 153 (M–484) 3 Jun. 1986.

*Primary Examiner*—Carl S. Miller

*Attorney, Agent, or Firm*—Robbins, Berliner & Carson, LLP

[57] ABSTRACT

A two part pressure unloading delivery valve for a fuel injection pump comprises an annular valve member within which is slidable a plunger. The valve member is biased into engagement with a valve seat by means of a spring and is lifted from the seat by fuel under pressure supplied by the pump. The spring biases the plunger in the direction away from the seat and following closure of the valve member the plunger is moved in the direction towards the seat to allow relief of fuel under pressure from the pipeline connecting the valve with a fuel injection nozzle. After a predetermined movement of the plunger against the spring, damping means in part defined by a piston on the plunger, acts to damp the further movement of the plunger.

6 Claims, 3 Drawing Sheets

CONTROL VALVE

This invention relates to a pressure unloading delivery valve for location between an outlet of a fuel injection pump and a pipeline connecting the outlet to a fuel injection nozzle of a compression ignition engine.

A known form of such a valve is seen in EP-B-0325858 in which an annular valve member is spring biased into engagement with a valve seat, the seat being defined about an inlet flow channel which connects with the outlet of the associated fuel injection pump. Slidable within the valve member is a plunger which moves against the loading of a spring to open a by-pass port thereby to allow fuel under pressure in the pipeline to flow to the outlet of the pump when the valve member is in the closed position. The pressure in the pipeline following delivery of fuel is therefore controlled.

The pressure differences and the fuel flow rates which are required result in rapid acceleration of the plunger and the attainment of a high velocity. This can lead to over stressing of the spring and possible fracture of the spring and in some cases to fracture of the plunger.

The object of the present invention is to provide a pressure unloading delivery valve in an improved form.

According to the invention a pressure unloading delivery valve for the purpose specified comprises an annular valve member engagable with a valve seat formed about a flow channel which in use is connected to the outlet of the fuel injection pump, said valve member being resiliently biased into engagement with the valve seat and being lifted from the seat to allow fuel to flow to an outlet which in use is connected to the pipeline, a plunger slidable in said valve member, resilient means biasing the plunger in the direction away from said seat, said plunger following delivery of fuel by the pump and closure of the valve member onto the seat, moving under the action of the fuel pressure in the outlet against the action of the resilient means to control said pressure, and damping means operable to damp the movement of said plunger after a predetermined movement of the plunger against the action of the resilient loading.

Figure 1:
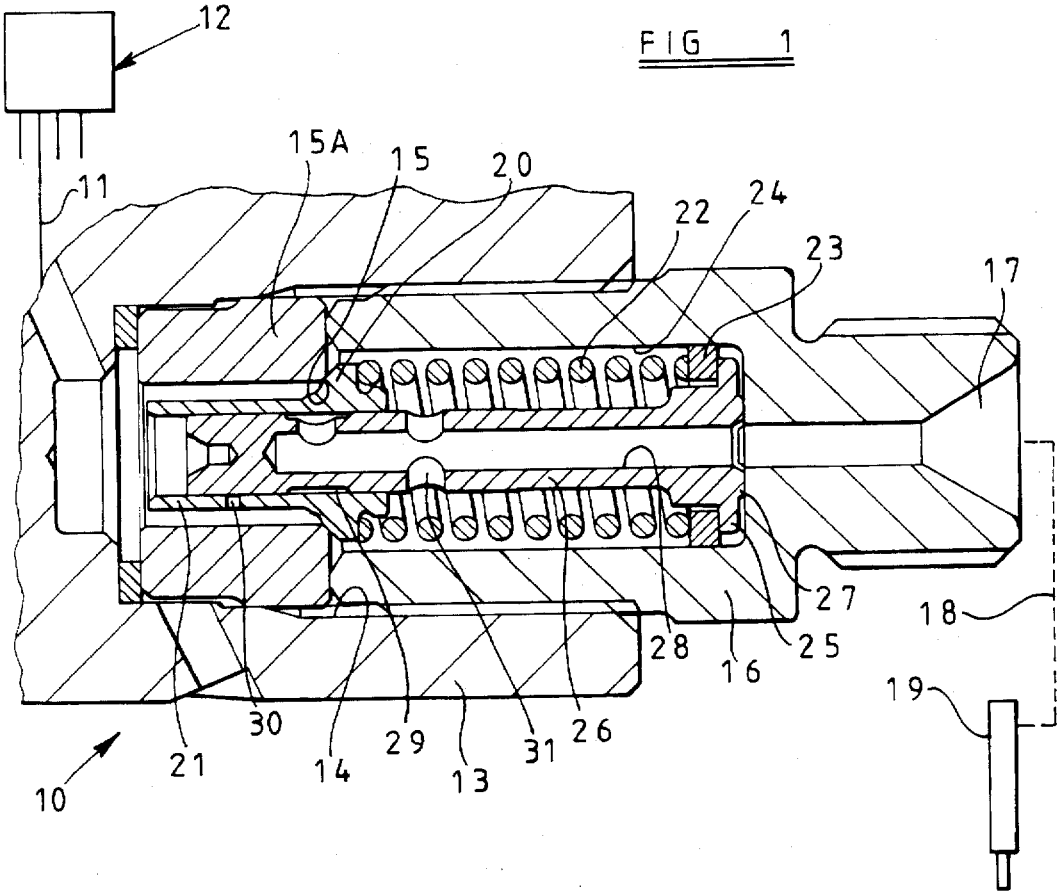
Figure 2:
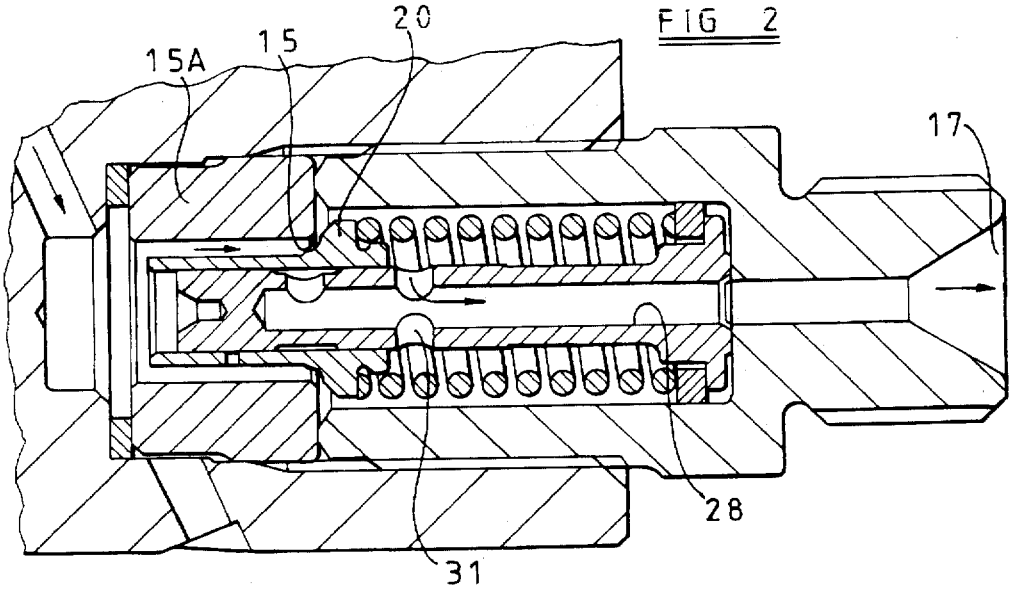
Figure 3:
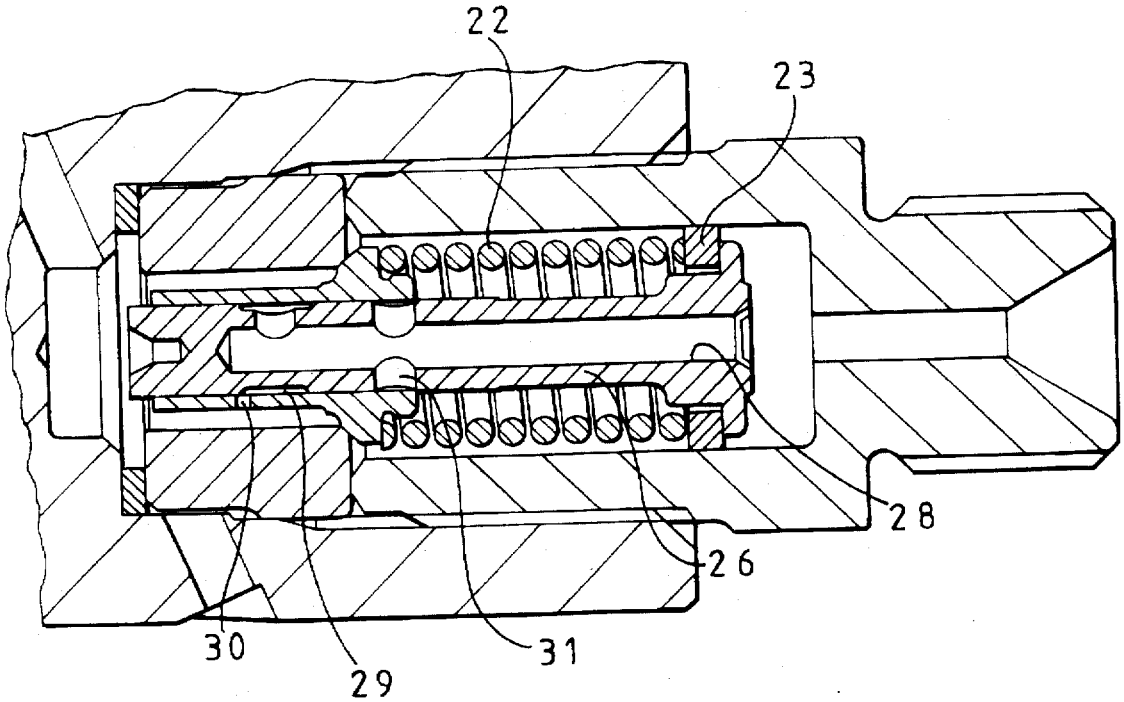
Figure 4:
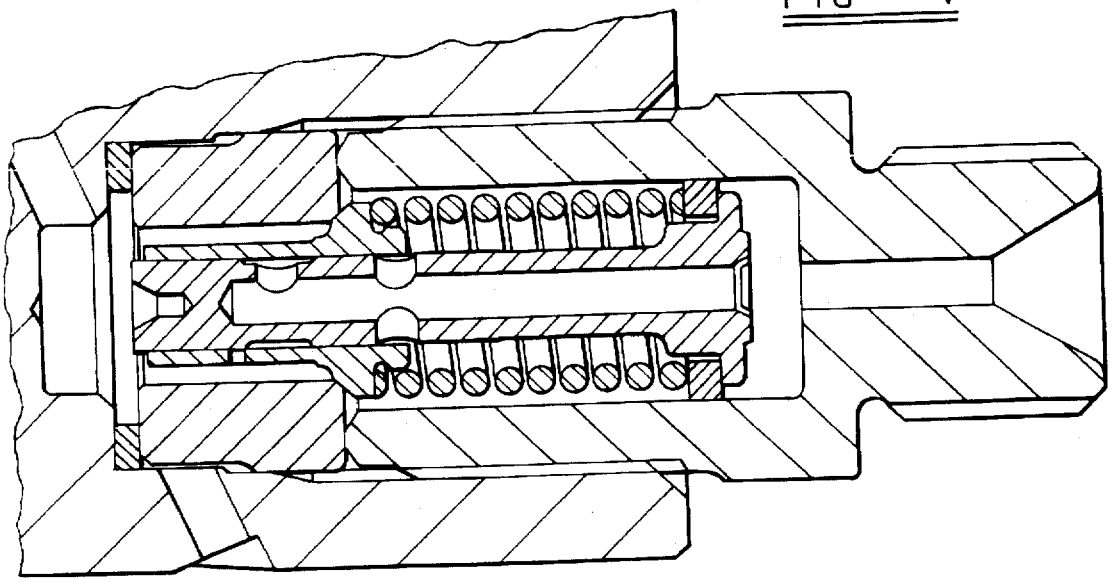
Figure 5:
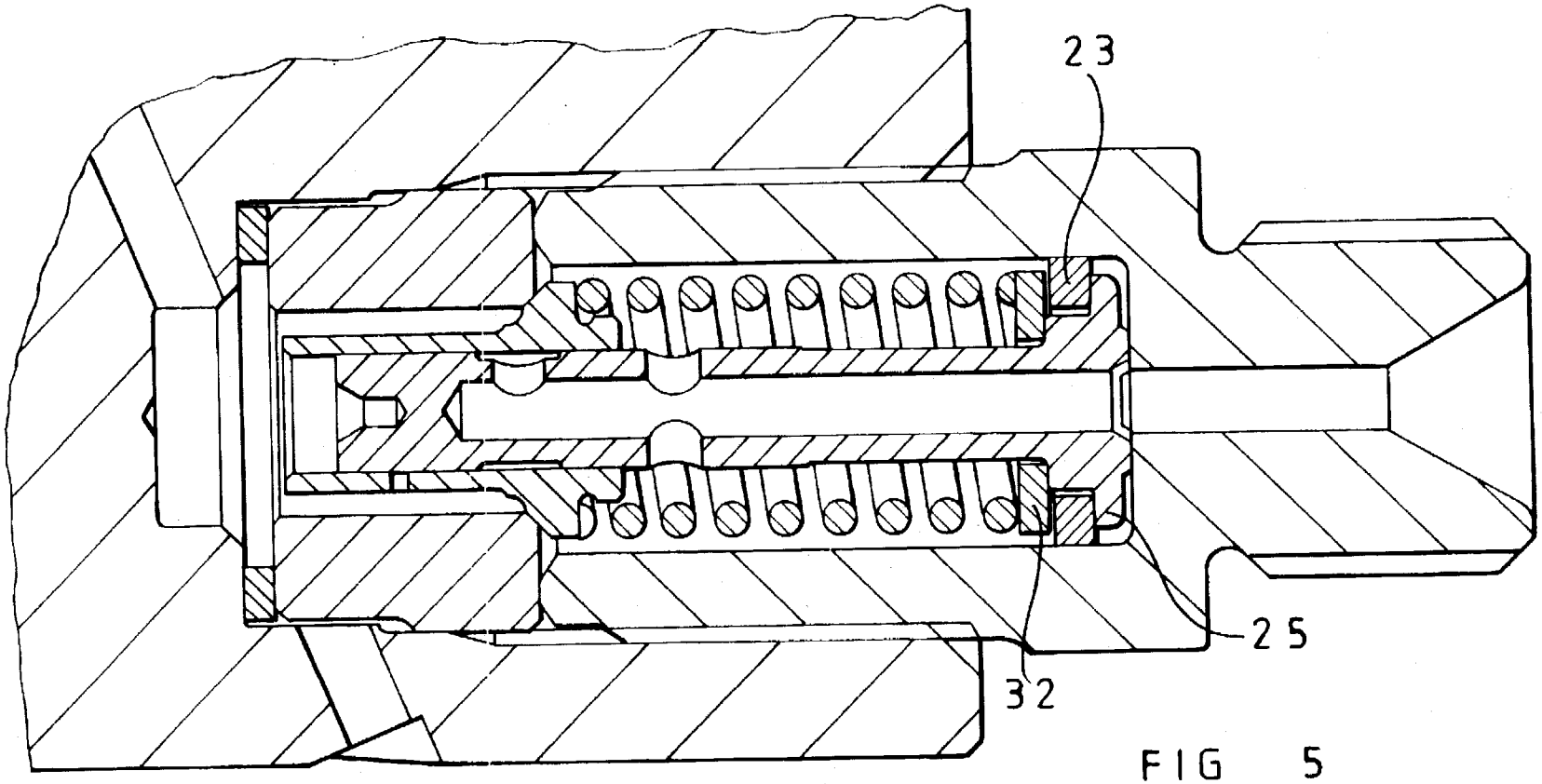

An example of a pressure unloading delivery valve in accordance with the invention will now be described with reference to the accompanying drawings in which:

FIG. 1 shows a sectional side elevation of the valve together with its connection, into one example of a fuel system for an internal combustion engine, FIGS. 2, 3 and 4 show various settings of the valve shown in FIG. 1, and FIG. 5 is a view similar to FIG. 1 showing a modification.

Referring to FIG. 1 of the drawings the unloading delivery valve is shown at 10 and is connected to one outlet 11 in the particular example, of a rotary distributor type fuel injection pump 12. The injection pump is of conventional design and employs a rotary distributor member in which there is formed a delivery passage which registers with the outlets 11 in turn, the delivery passage being connected to a bore containing a pair of cam actuated pumping plungers. Conveniently the body 13 of the valve is part of the housing of the pump 12. Formed in the body 13 is a bore 14 at one end of which is located an annular valve seat member 15A which defines a valve seat 15. The adjacent end of the bore is connected to the outlet 11 and the seat is held in position by means of an annular hollow cap 16 which is in screw thread engagement with the bore and which engages the seat member 15A. The cap 16 defines an outlet 17 for connection to a pipeline 18 extending between the delivery valve and a fuel injection nozzle 19.

Also provided is an annular valve member 20 which is shaped for cooperation with the valve seat 15. The valve member includes a hollow portion 21 having a non-circular outer surface which engages the wall of the flow passage defined by the valve seat member 15A to guide the movement of the valve member whilst allowing for fuel flow along the flow passage. The valve member 20 is biased into engagement with the valve seat 15 by resilient means in the form of a coiled compression spring 22 one end of which is in engagement with the valve member and the other end of which is in engagement with an annular piston member 23 which is in sliding engagement with the cylindrical internal surface 24 of the cap 16. The piston member is engaged beneath a flange 25 which is located at one end of a plunger 26 slidable within the valve member 20 and the portion 21.

In the rest position as shown in FIG. 1, the end surface of the flange 25 is held in engagement with the adjacent end surface of the cylindrical chamber defined in the cap 16 and conveniently the end surface of the flange is provided with a transverse slot 27. The plunger 26 is provided with an axially extending blind drilling 28 which extends inwardly from the flanged end of the plunger. The opposite and closed end of the drilling communicates with a circumferential groove 29 formed on the periphery of the plunger and this groove as seen in FIG. 1, is in the rest position of the valve, spaced from a by-pass orifice 30 formed in the wall of the portion 21. In addition, the blind drilling intermediate its ends is in communication with a transverse passage 31 the opposite ends of which open onto the periphery of the plunger at a position axially spaced from the adjacent end of the valve member.

In operation, during delivery of fuel by the fuel injection pump, the valve member 20 as shown in FIG. 2, is lifted from the valve seat 15 and fuel can flow to the outlet 17 and hence to the associated fuel injection nozzle 19, through the transverse passage 31, the drilling 28 and the outlet 17. When the delivery of fuel by the fuel injection pump ceases, the valve member 20 is urged very quickly into engagement with the valve seat as shown in FIG. 3. FIG. 3 also shows displacement of the plunger 26 against the action of the spring 22 under the action of the fuel pressure in the pipeline 18. As such movement takes place the pipeline is depressurised and at some stage in the movement the circumferential groove 29 moves into communication with the by-pass orifice 30 so that fuel can now flow towards the outlet 11 of the pump by way of the drilling 28, the groove 29 and the by-pass port 30 to effect further depressurisation. It will also be noted that the outer ends of the transverse passage 31 are closed by the valve member thus preventing transfer of fuel between the portions of the chamber in the cap which are on opposite sides of the piston. The portion of the chamber which lies below the piston 23 is therefore isolated hydraulically and thus forms a dash pot chamber to slow the movement of the plunger thereby preventing excessive stressing and compression of the spring 22. Fuel can flow through the by-pass orifice until such time as the pressure in the pipeline has reduced whereupon the plunger moves under the influence of the spring until the by-pass orifice is just closed as shown in FIG. 4.

The pressure in the pipeline is therefore stabilised at a value which is determined by the force exerted by the spring and the effective area of the plunger.

In a distributor type pump the delivery passage moves out of register with an outlet 11 following the delivery of fuel and during this period and before the next delivery of fuel to that outlet, it can be arranged that the plunger moves to the position shown in FIG. 1 by careful choice of the working clearance between the plunger and the valve member and the associated hollow portion 21.

FIG. 5 shows a modification to the mounting of the piston 23. In the example above the piston 23 is engaged by the spring and urged into engagement with the flange 25. This could prevent lateral movement of the piston 23 to allow for manufacturing tolerances. As a result side thrust could be imposed on the plunger. In the arrangement of FIG. 5 a spring abutment 32 is provided and this locates against a step defined on the plunger. The piston is located with clearance between the spring abutment and the flange 25 and therefore is relieved of the spring force and can move laterally as required between the spring abutment and the flange.

The slot 27 which communicates with the passage 28 provides for pressure equalization across the piston 23 and also allows fuel to flow to the pipeline and nozzle in the event that the ends of the transverse passage 31 become blocked, such flow taking place along the working clearance between the piston and the cylindrical surface 24.

We claim:

1. A pressure unloading delivery valve for location between a pump outlet of a fuel injection pump and a pipeline connecting the outlet to a fuel injection nozzle of a compression ignition engine comprising an annular valve member biased into engagement with a valve seat formed about a flow channel through which fuel flows from the pump outlet to the pipeline, the valve member being lifted from the valve seat to allow fuel to flow to a delivery valve outset connected to the pipeline, a plunger slidable in said valve member, resilient means biasing the plunger in a direction away from the seat, said plunger following delivery of fuel by the pump and closure of the valve member onto the valve seat, moving under the action of the resilient means to control said pressure, and damping means operable to damp the movement of said plunger after a predetermined movement of the plunger against the action of said resilient means, in which said damping means comprises a piston mounted on the plunger, said piston cooperating with a cylindrical surface to form on one side a dash pot chamber, said chamber being in communication with said pump outlet until the plunger has moved through said predetermined movement.

2. A delivery valve according to claim 1, in which said plunger defines a passage which extends between said dash pot chamber and a chamber defined on the opposite side of the piston, said passage at one end terminating in a port which is positioned to be covered by said valve member when the plunger has moved through said predetermined movement.

3. A delivery valve according to claim 2, in which said passage and said port form part of said flow channel.

4. A delivery valve according to claim 1, in which said piston is disposed adjacent a flange formed on said plunger.

5. A delivery valve according to claim 4, including a spring abutment carried on said plunger, said piston being positioned between said flange and the spring abutment and being capable of moving in a direction transverse to the direction of movement of the plunger.

6. A delivery valve according to claim 4, in which said piston is urged into engagement with said flange by a coiled compression spring which forms said resilient means.

* * * * *